US011156962B2

(12) United States Patent
Kaltenrieder et al.

(10) Patent No.: US 11,156,962 B2
(45) Date of Patent: Oct. 26, 2021

(54) STEM-CROWN OF A WATER-RESISTANT WATCH CASE, AND WATCH CASE COMPRISING SAME

(71) Applicant: Omega SA, Biel/Bienne (CH)

(72) Inventors: Cedric Kaltenrieder, Courtelary (CH); Gregory Kissling, La Neuveville (CH); Herve Avril, Les Breuleux (CH); Ricardo Marcos, Worben (CH); Samuel Geiser, Bienne (CH); John Ramsay, Maevy (GB)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 16/847,831

(22) Filed: Apr. 14, 2020

(65) Prior Publication Data

US 2020/0356054 A1 Nov. 12, 2020

(30) Foreign Application Priority Data

May 8, 2019 (EP) ..... 19173327

(51) Int. Cl.
*G04B 3/04* (2006.01)
*G04B 37/10* (2006.01)

(52) U.S. Cl.
CPC ..... *G04B 3/041* (2013.01); *G04B 37/103* (2013.01)

(58) Field of Classification Search
CPC ..... G04B 3/041; G04B 37/103; G04B 37/10; G04B 37/066; G04B 3/001; G04B 3/046; G04B 3/048; G04B 37/106; G04B 27/002; G04B 27/02; G04B 37/04
USPC ..... 368/289
See application file for complete search history.

(56) References Cited

U.S. PATENT DOCUMENTS 10,152,024 B2 * 12/2018 Baebler ..... G04B 37/10
10,613,481 B2 * 4/2020 Iguchi ..... G04B 3/046

FOREIGN PATENT DOCUMENTS

CH 291 565 A 6/1953
CN 1530776 A 9/2004
DE 16 15 029 U 10/1950
DE 1615029 U 10/1950
(Continued)

OTHER PUBLICATIONS

European Search Report dated Nov. 1, 2019 in European Application 19173327.8 filed on May 8, 2019 (with English Translation of Categories of Cited Documents), 4 pages.
(Continued)

*Primary Examiner* — Edwin A. Leon
(74) *Attorney, Agent, or Firm* — Oblon, McClelland, Maier & Neustadt, L.L.P.

(57) ABSTRACT

A stem-crown of a water-resistant watch case includes a stem inserted into a tubular opening of a middle part of the watch case, and a crown including a first portion connected to the stem and a second handling portion. The first portion of the crown includes an annular contact surface, which is inclined at a determined angle less than 90° relative to a longitudinal central axis of the stem-crown, extending from the link between the stem and the first portion of the crown towards the outside of the second portion of the crown. In a rest position, the first portion of the crown comes into contact or bears against an annular receiving surface of the middle part, the shape thereof complements that of an end of the tubular opening to the outside.

11 Claims, 3 Drawing Sheets

(56) References Cited

FOREIGN PATENT DOCUMENTS

| | | | |
|---|---|---|---|
| FR | 1 491 824 | A | 8/1967 |
| GB | 309 485 | A | 2/1930 |
| JP | 55-150389 | | 10/1980 |
| JP | 4-79293 | U | 7/1992 |
| JP | 2000-249775 | A | 9/2000 |
| JP | 2005-30765 | A | 2/2005 |
| JP | 2007-132779 | A | 5/2007 |

OTHER PUBLICATIONS

Notice of the Reason for Refusal dated Feb. 24, 2021 in Japanese Patent Application No. 2020-077146 (with English language translation), 7 pages.

Chinese Office Action issued in Chinese Patent Application No. 202010376863.4 dated Jun. 18, 2021, (w/ English Translation), citing references AO-AP therein.

* cited by examiner

STEM-CROWN OF A WATER-RESISTANT WATCH CASE, AND WATCH CASE COMPRISING SAME

CROSS-REFERENCE TO RELATED APPLICATION

This application claims priority to European Patent Application No. 19173327.8 filed on May 8, 2019, the entire disclosure of which is hereby incorporated herein by reference.

TECHNICAL FIELD

The present invention relates to a control member, such as a stem-crown of a water-resistant watch case in particular for a diving watch.

The invention further relates to a watch case comprising a control member, such as a stem-crown for setting time parameters or other functions for a diving watch.

TECHNOLOGICAL BACKGROUND

To provide for the use of a mechanical or electronic watch underwater, the watch case, which comprises a horological movement or a time-based horological module, must be sealingly closed. For this purpose, the watch case comprises a back sealingly fastened to a first side of a middle part and a crystal fastened to a second opposite side of the middle part. Packings are provided for the assembly of the back, the middle part and the crystal of the watch. A watch function control or setting member is also sealingly mounted through the middle part of the case in the rest position.

Generally watch cases with the control or setting member are not configured or assembled to withstand high water pressures, for example during a dive since the pressure inside the watch case is close to atmospheric pressure. Simple packings of traditional watches are not enough to guarantee a good water resistance of the case during a dive to very large depths underwater.

Mention may be made of the patent application CH 690 870 A5 which describes a water-resistant watch case. The watch case consists of a crystal fastened on an upper side to a middle-bezel and a back fastened to the middle part by screwing it to an internal tapping of the middle part. The crystal is fastened to the middle part by an annular packing of a toroidal shape and bearing on a rim of the middle part. A packing is also provided between an outer rim of the back and a lower surface of the middle part. As the tapping can be damaged at high water pressure, a dome made of a resistant metal is also provided, bearing against an inner surface of the back and against an inner edge of the middle part. However, even with such a watch case arrangement, this does not allow guaranteeing a good water-resistance of the case during a dive to very large depths underwater, which constitutes a disadvantage.

The patent CH 372 606 describes a water-resistant watch case, which has a central portion or middle part surrounding a back and closed by a crystal. A threaded ring is bearing against an inclined outer surface of the back to retain it, and is screwed to a fastening portion connected to the middle part. With such an arrangement presented, this does not allow guaranteeing a good water-resistance of the case during a dive to very large depths underwater, which constitutes a disadvantage.

The patent application EP 3 432 084 A1 discloses a control member such as a stem-crown, mounted through the middle part of a watch case. The stem-crown comprises a threaded part for being screwed to a tapping of a through hole in the middle part. A top part of the stem, which is larger in diameter than the threaded part thereof, bears in a rest position against a corner in the bottom of a recess for receiving the top part of the stem. A packing, that is toroidal in shape, is disposed in an annular groove of the top part of the stem and in contact with the inner wall of the recess to guarantee water resistance. However, such an arrangement as presented does not guarantee good water-resistance of the case with the control member thereof during a dive to very large depths underwater, which constitutes a disadvantage.

SUMMARY OF THE INVENTION

Therefore, the main purpose of the invention is to overcome the disadvantages of the prior art described above by proposing, on the one hand, a control member, such as a stem-crown of a water-resistant watch case, and on the other hand a water-resistant watch case adapted to withstand the high water pressure when diving to large depths under water.

To this end, the present invention relates to a control member, such as a stem-crown of a water-resistant watch case, which comprises the features of the independent claim 1.

Particular embodiments of the control member are defined in the dependent claims 2 to 6.

An advantage of the control member of a water-resistant watch case lies in the fact that it takes on the form of a stem-crown, the crown whereof comprises a first portion and a second handling portion. The first portion has an annular contact surface which is inclined at a determined angle less than 90° relative to a central longitudinal axis of the stem-crown so as to be able to come into contact with an annular receiving surface of the middle part, which has a complementary shape. In this manner, once the stem-crown has been mounted on the middle part of the watch case, any pressure difference between the water and the pressure inside the watch case tends to close any interstice between the contacting surfaces inclined towards the inside of the watch case.

To this end, the present invention further relates to a water-resistant watch case with at least one control member, such as a stem-crown, which comprises the features of the independent claim 8.

Embodiments of the water-resistant watch case are defined in the dependant claims 9 to 11.

Advantageously, the crown has an annular contact surface which is inclined at a determined angle less than 90° relative to a central longitudinal axis of the stem-crown so as to come into contact with an annular receiving surface of the middle part, which has a complementary shape in a rest position.

BRIEF DESCRIPTION OF THE FIGURES

The purposes, advantages and features of the control member, such as a stem-crown of a water-resistant watch case, and the watch case comprising same will appear better in the following description in a non-limiting manner with reference to the drawings wherein.

DETAILED DESCRIPTION OF THE INVENTION

In the following description, all the components of a case of a water-resistant watch, in particular a diving watch, which are well known to a person skilled in the art in this technical field, are only stated in a simplified manner.

Figure 1:
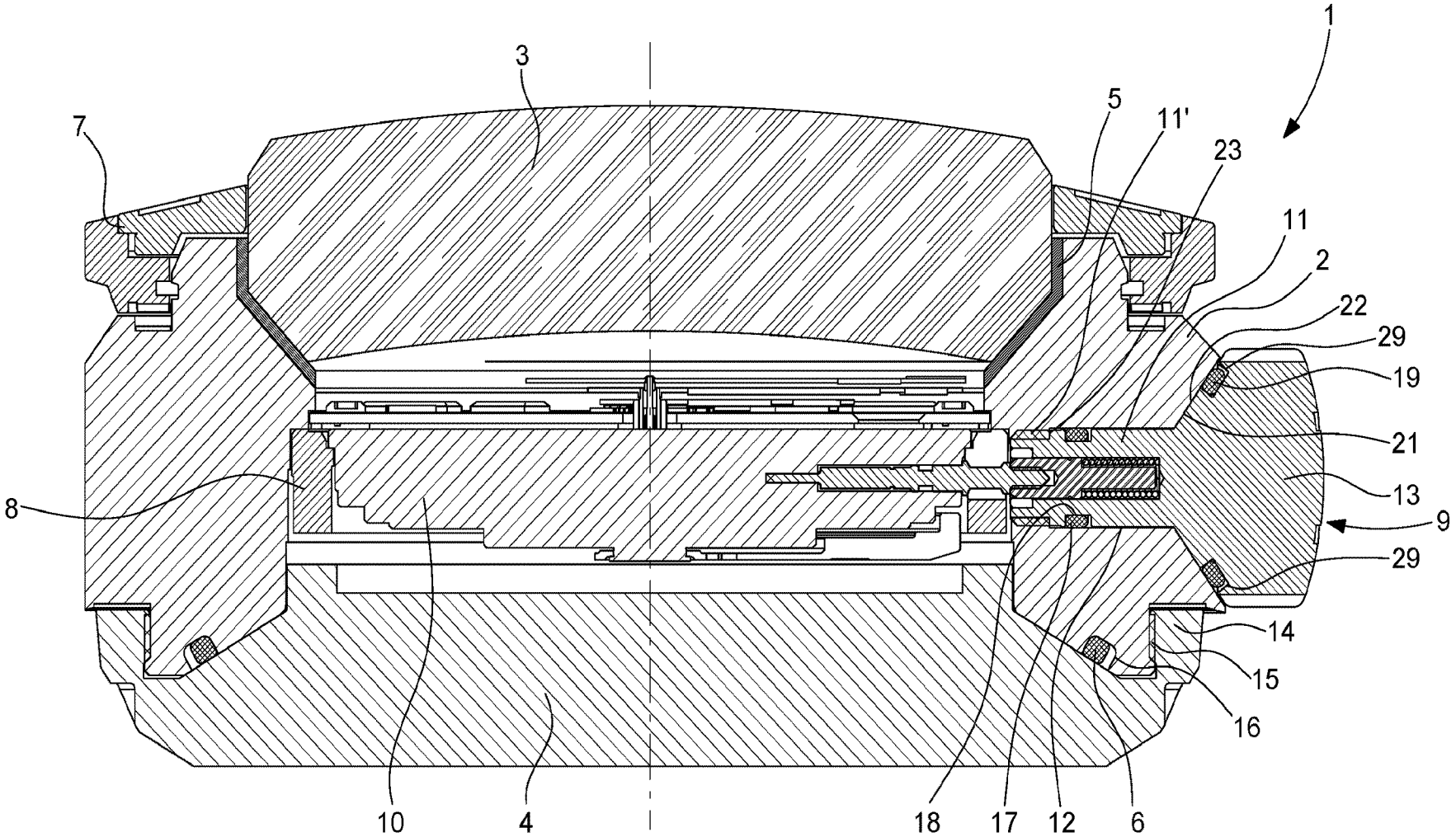
FIG. 1 shows, in a simplified manner, a cross-section of a water-resistant case of a diving watch according to the invention.

FIG. 1 shows a watch case 1, which can be used for a diving watch. The watch case 1 essentially comprises a crystal 3, which can be made of sapphire or mineral glass, fastened on an upper side of a middle part 2, potentially a back 4 mounted on a lower side of the middle part 2, and at least one control member 9, such as a stem-crown as shown. The control member 9 can be mounted in a water-resistant manner in the rest position on or through the middle part 2 or in the setting position as explained in more detail hereinbelow with reference to FIGS. 2*a* and 2*b*. This control member 9 can be used to set the time, the date or other functions for a diving watch. A bezel 7 can also be mounted on the upper side of the middle part 2. A horological movement or module 10 is disposed in the watch case 1 in a casing circle 8.

The control member 9 is present in the form of a stem-crown 9. It mainly comprises a stem 11 and a crown 13 capable of being handled by one hand of a user from outside the watch case 1. In the rest position, as shown in FIG. 1, the stem 11 passes through a tubular opening 12 in the middle part 2. This stem 11 is extended by another inner stem to provide access to the inside of the watch case 1 for setting parameters regarding the time or other functions of a diving watch. The stem 11 can be held by a retaining means 23 inside the tubular opening 12 in the middle part 2 or at the entry thereof in the watch case, in particular in the rest position in which setting operations cannot take place. Preferably, the stem 11 comprises, at one end towards the inside of the watch case 1, a threaded portion 11' to be screwed onto an internal tapping 23, acting as retaining means, inside the tubular opening 12 of the middle part 2. The stem 11 further comprises an annular groove 18 with a packing 17 that is toroidal in shape in contact with the inner surface of the tubular opening 12, the diameter thereof is slightly greater than the diameter of the stem 11. The annular groove 18 is disposed between the threaded portion 11' and the crown 13, and preferably closer to the threaded portion 11', such that in the setting position, the packing 17 remains in contact inside the tubular opening 12.

The crown 13 comprises a first portion directly connecting the stem 11 to a second handling portion. The first portion comprises an annular contact surface 21, which is inclined at a determined angle less than 90° relative to a central longitudinal axis of the stem-crown 9, extending from the link between the stem 11 and the first portion of the crown 13 towards the outside of the second portion of the crown 13 or of the watch case 1. The first portion of the crown further comprises a second annular groove 29 housing a second packing 19 (Butadiene Rubber Nitrile) which is toroidal in shape, and which is located close to the link between the first portion and the second handling portion of the crown 13. The second annular groove 29 can have a rectangular cross-section in order to retain the second packing 19 in the groove in the setting position of the stem-crown 9.

The annular contact surface 21 of the first portion of the crown 13 is inclined by a determined angle in order to come into contact with an annular receiving surface 22 of the middle part 2 in the rest position. This annular receiving surface 22 has a shape that complements that of the annular contact surface 21 and normally with the same angle of inclination as the annular contact surface 21. In the case where the annular contact surface 21 of the first portion of the crown 13 has a conical shape, in the same manner as the annular receiving surface 22 of the middle part 2, the angle of inclination a of the surfaces 21, 22 can be of the order of 55°±10°, but preferably 55°, or even 65°.

It should also be noted that the first portion and the second portion of the crown 13 only form one solid piece, for example made of one material, such as titanium, in the same manner as the middle part 2 for example. The stem 11 can also be directly integral with the crown so as to form only one piece.

The back 4 comprises an annular rim 14 with internal tapping so as to be screwed onto a tapping 15 on the lower side of the middle part 2. An annular bearing surface of the back 4 comes into contact with an inner annular surface of the middle part 2 of a shape complementary to the bearing surface when mounting the back 4 on the middle part 2. The bearing and inner surfaces are inclined at a determined angle relative to an axis perpendicular to a plane of the watch case 1. In the case of a middle part of a generally cylindrical shape, the bearing and inner surfaces are conical in shape and are inclined towards the inside of the watch case 1 at a determined angle relative to a central axis of the watch case 1. The lower side of the middle part 2 also comprises an annular groove 16 housing a packing 6 (Butadiene Rubber Nitrile) of a toroidal shape in contact with the bearing surface when the back 4 is mounted on the middle part 2. For a middle part 2 and a back 4, made of a material, such as titanium, the angle can be of the order of 60°±5° relative to the central axis. This allows having a good stress distribution between the back 4 and the middle part 2 due to the water pressure during a dive to large depths underwater.

The crystal 3 is fastened to the middle part 2 according to the same principle as that of mounting the back 4 to the middle part 2. For this purpose, the crystal 3 comprises an annular peripheral surface to be fastened by means of a fastening gasket 5 on an inner annular surface on the upper side of the middle part 2. The inner annular surface is of a shape complementary to the annular peripheral surface. The annular peripheral surface 13 of the crystal 3 is inclined at a defined angle less than 90° relative to an axis perpendicular to a plane of the watch case 1. Preferably, the inner annular surface is inclined generally towards the inside of the watch case 1 at the same angle as the annular peripheral surface relative to a central axis. Although the middle part 2 is of a generally cylindrical shape, the inner annular surface and the annular peripheral surface are conical in shape. The defined angle of inclination of the surfaces can be of the order of 43°±5° relative to the central axis. This allows having a good stress distribution between the crystal 3 and the middle part 2 due to the water pressure during a dive to large depths underwater. The difference in water pressure compared to the pressure inside the watch case 1 tends to close any interstice between the surfaces in contact with the fastening gasket 5 thanks to the inclination of the contact surfaces towards the inside of the watch case 1. This guarantees a good water-resistance and ability to withstand high pressures.

The fastening gasket 5 presented can be made of amorphous metal or amorphous metal alloy. The fastening gasket 5 is of an annular shape for the hermetic closure of the crystal 3 on the middle part 2. For a middle part 2 having an overall cylindrical shape, the fastening gasket 5 comprises a conical part positioned underneath a cylindrical part attached to an inner annular wall of the middle part 2 and an outer annular wall of the crystal 3. The crystal 3 is fastened to the middle part 2 by means of the gasket made of amorphous metal after a hot fastening operation.

Several types of amorphous metal alloys can be used to make the entire one-piece metal gasket 5, 5'. In the most frequent cases, the amorphous metal alloy can be mainly composed of zirconium, which allows forming the gasket at a temperature higher than 350° C., that is to say higher than the glass transition temperature of the alloy. The zirconium-based amorphous metal alloy can be composed of Zr(52.5%), Cu(17.6%), Ni(14.9%), Al(10%) and Ti(5%). The zirconium-based amorphous metal alloy may also comprise Zr(58.5%), Cu(15.6%), Ni(12.8%), Al(10.3%) and Nb(2.8%). The zirconium-based amorphous metal alloy may also comprise Zr(44%), Ti(11%), Cu(9.8%), Ni(10.2%) and Be(25%), or finally Zr(58%), Cu(22%), Fe(8%) and Al(12%). Preferably, to facilitate the production of such a gasket, the amorphous metal alloy can be mainly composed of platinum (Pt), which allows the gasket to be formed at a temperature above 230° C. The platinum-based amorphous metal alloy may comprise Pt(57.5%), Cu(14.7%), Ni(5.3%) and P(22.5%). It is also possible to provide for making the one-piece metal gasket 5, 5' of an amorphous metal alloy based mainly on palladium (Pd), which allows forming the gasket at a temperature above 300° C.

Other alloys of amorphous metals can also be mentioned. A titanium-based amorphous metal alloy may comprise Ti(41.5%), Zr(10%), Cu(35%), Pd(11%) and Sn(2.5%). A palladium-based amorphous metal alloy may comprise Pd(43%), Cu(27%), Ni(10%) and P(20%), or Pd(77%), Cu(6%) and Si(16.5%), or finally Pd(79%), Cu(6%), Si(10%) and P(5%). A nickel-based amorphous metal alloy may comprise Ni(53%), Nb(20%), Ti(10%), Zr(8%), Co(6%) and Cu(3%), or Ni(67%), Cr(6%), Fe(4%), Si(7%), C(0.25%) and B(15.75%), or finally Ni(60%), Pd(20%), P(17%) and B(3%). An iron-based amorphous metal alloy may comprise Fe(45%), Cr(20%), Mo(14%), C(15%) and B(6%), or Fe(56%), Co(7%), Ni(7%), Zr(8%), Nb(2%) and B(20%). A gold-based amorphous metal alloy may comprise Au(49%), Ag(5%), Pd(2.3%), Cu(26.9%) and Si(16.3%).

Figure 2A:
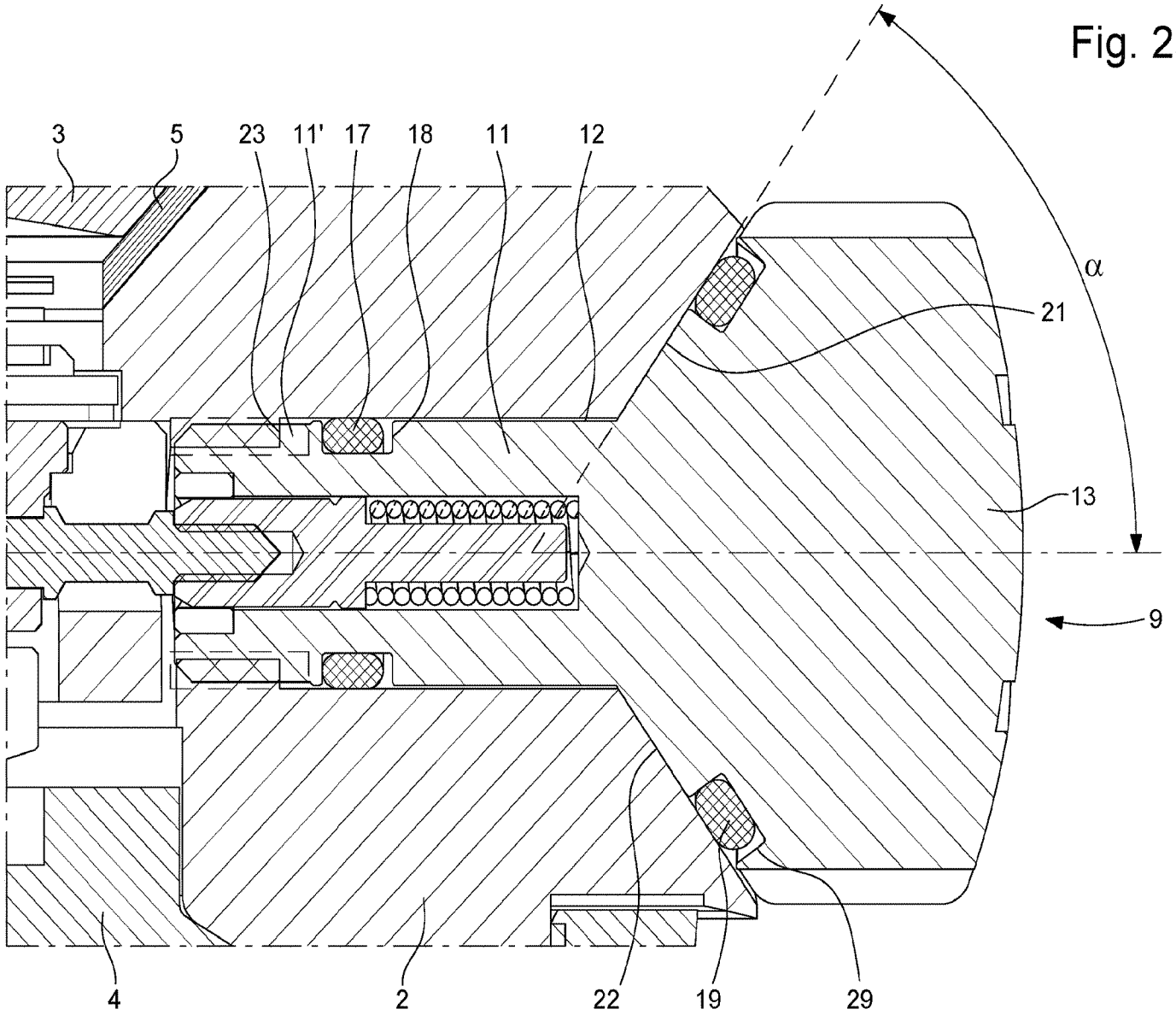
FIGS. 2*a* and 2*b* show, on the one hand, a detailed cross-section of the water-resistant case focusing on the control member in the rest position according to the invention, and on the other hand a detailed cross-section of the water-resistant case focusing on the control member in the setting position according to the invention.
Figure 2B:
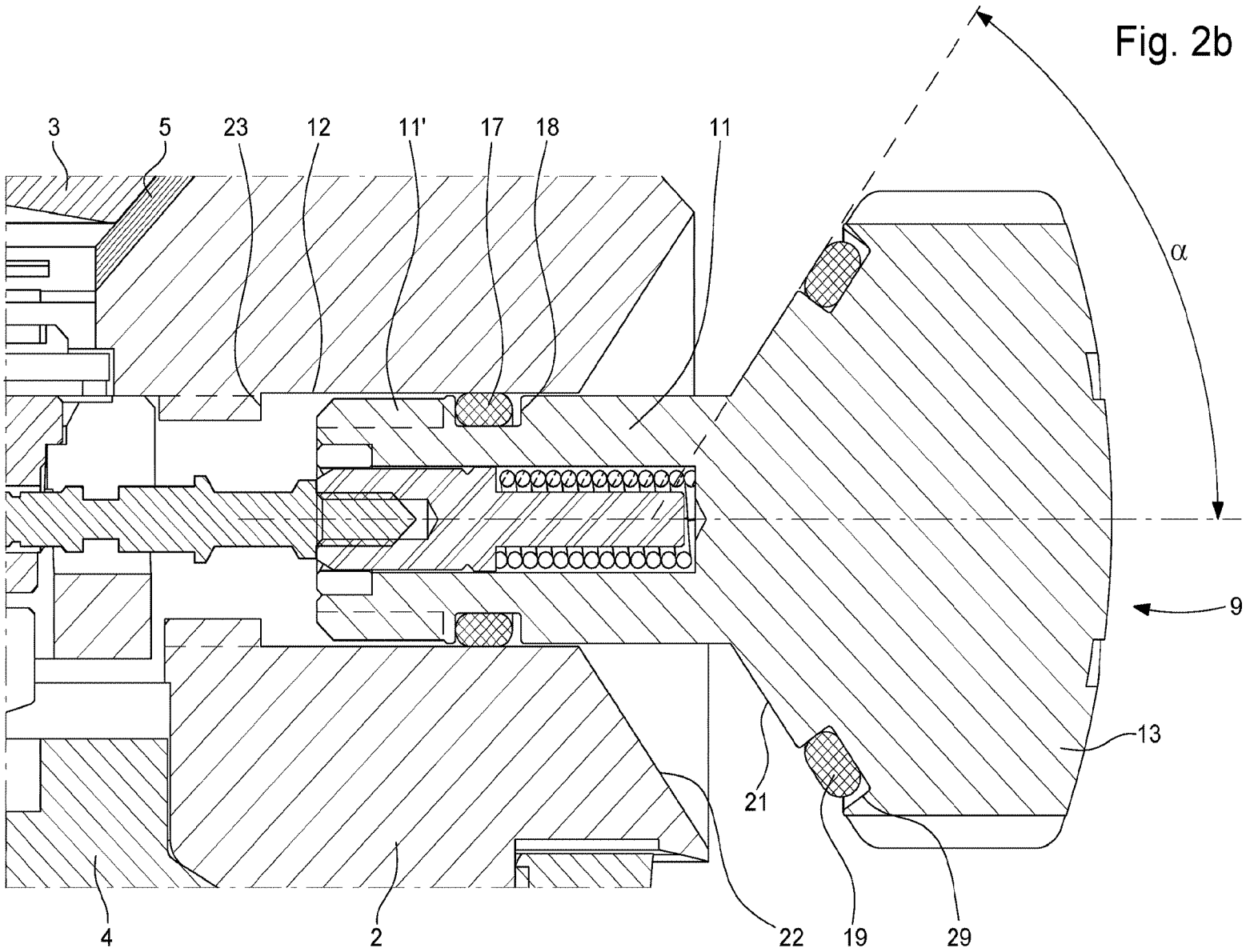

FIGS. 2*a* and 2*b* show a more detailed view, on the one hand of a cross-section of the watch case focused on the control member 9 in the rest position in the middle part 2 (FIG. 2*a*), and on the other hand of a cross-section of the watch case focused on the control member 9 in the setting position partially outside of the opening 12 in the middle part 2 (FIG. 2*b*). For simplicity purposes, only the elements related to the control member 9 and to the middle part 2 will be described, since all the elements of the watch case have already been mentioned hereinabove with reference to FIG. 1.

In this embodiment, the annular contact surface 21 of the first portion of the crown 13 is considered to be conical in shape, and the annular receiving surface 22 of the middle part 2 is considered to have a shape that complements that of the annular contact surface 21. In FIG. 2*a*, the first portion of the crown 13 is placed such that it bears conically in the recess at the annular receiving surface 22 of the middle part 2, once the threaded portion 11 of the stem 11 has been screwed into the internal tapping 23 of the tubular opening 12 of the middle part 2. The angle of inclination a of the surfaces 21, 22 can be of the order of 55°±10°, and preferably 55°, or even 65°. In this rest position, the second packing 19 bears against the annular receiving surface 22 of the middle part 2. A seal is maintained thereby, however when the diving watch is at large depths underwater, the conical contact arrangement between the crown 13 and the middle part 2 allows any interstice between the contacting surfaces to be hermetically sealed with an improved distribution of stresses.

In order to set the time parameters or other functions for a diving watch as shown in FIG. 2*b*, the crown 13 is rotated in order to unscrew the portion 11' of the tapping 23 of the tubular opening 12, and the crown 13 is pulled outwards relative to the watch case. Normally, the stem 11 is connected towards the inside of the watch case, by another inner stem, to a component for setting the time parameters or other functions of the diving watch, however only the stem-crown 9 considered to form a part of the watch case has been described.

It should also be noted that the cross-section of the first portion of the crown 13 can also be considered to be square, rectangular or polygonal. This means that the annular contact surface 21 of the crown can be formed by a plurality of portions having an inclined plane linked to one another in order to form the annular bearing surface. Under these conditions, the retaining means 23 in the tubular opening 12 can no longer be a tapping, but rather a catch or hook or other retaining means.

From the description which has just been made, several alternative embodiments of the control member, such as a stem-crown and of the watch case can be designed by a person skilled in the art without departing from the scope of the invention defined by the claims.

What is claimed is:

1. A stem-crown of a water-resistant watch case for a diving watch, the stem-crown comprising:

a stem configured to be inserted into a tubular opening of a middle part of the watch case; and a crown including a first portion connected to the stem and a second handling portion, wherein the first portion of the crown comprises an annular contact surface, which is inclined at a determined angle less than 90° relative to a longitudinal central axis of the stem-crown, extending from the link between the stem and the first portion of the crown towards the outside of the second portion of the crown, the first portion of the crown configured to come into contact with an annular receiving surface of the middle part of a complementary shape, wherein the stem is held by a retaining means inside the tubular opening in the middle part or at the entry thereof in the watch case, and wherein an annular groove is made in the first portion of the crown closer to the second portion of the crown than the stem, the annular groove receiving a second packing, that is toroidal in shape.

2. The stem-crown according to claim 1, characterised in that the annular contact surface is a conical surface.

3. The stem-crown according to claim 1, wherein the angle of inclination of the annular contact surface is of the order of 55°±10°.

4. The stem-crown according to claim 3, wherein the angle of inclination of the annular contact surface is 55° or 65°.

5. The stem-crown according to claim 1, wherein one end of the stem comprises a threaded portion so as to be able to be screwed into a tapping as a retaining means of a tubular opening of a middle part of the watch case.

6. The stem-crown according to claim 5, wherein between the threaded portion and the first portion of the crown, a second annular groove is made in the stem in order to receive a first packing, that is toroidal in shape.

7. A watch case comprising the stem-crown according to claim 1, the watch case further comprising:

at least one back mounted on a lower side of a middle part; and a crystal mounted on an upper side of the middle part, wherein the middle part includes a tubular opening through which the stem of the stem-crown passes and an annular receiving surface of the middle part at one end towards the outside of the tubular opening for receiving the first portion of the crown in the rest position, wherein the annular receiving surface of the middle part has a shape that complements the annular contact surface, with a determined angle of inclination less than 90° relative to a longitudinal central axis of the tubular opening towards the outside of the watch case, and wherein the stem is held by a retaining means inside the tubular opening in the middle part or at the entry thereof in the watch case.

8. The watch case according to claim 7, wherein the annular receiving surface of the middle part is conical in shape.

9. The watch case according to claim 7, wherein the angle of inclination of the annular receiving surface is of the order of 55°±10° and equivalent to the angle of inclination of the annular contact surface.

10. The watch case according to claim 7, wherein in the rest position of the stem-crown, the tubular opening comprises an internal tapping acting as retaining means in which a threaded portion of the stem is screwed, the annular contact surface bearing against the annular receiving surface.

11. The watch case according to claim 7, wherein a second annular groove is made in the stem for receiving a first packing, that is toroidal in shape, in contact with the inner surface of the tubular opening.

* * * * *